US005716007A

United States Patent [19]

Nottingham et al.

[11] Patent Number: 5,716,007

[45] Date of Patent: Feb. 10, 1998

[54] BATTERY OPERATED FLUID DISPENSER

[75] Inventors: John R. Nottingham, Hunting Valley; John W. Spirk, Jr., Gates Mills; Richard O. McCarthy; Dale A. Panasewicz, both of Strongsville, all of Ohio

[73] Assignee: Nottingham-Spirk Design Associates, Inc., Cleveland, Ohio

[21] Appl. No.: 580,612

[22] Filed: Dec. 29, 1995

[51] Int. Cl.[6] ..... B05B 9/04

[52] U.S. Cl. ..... 239/332; 239/351; 239/375; 222/333

[58] Field of Search ..... 239/329, 331, 239/332, 333, 351, 375; 222/333

[56] References Cited

U.S. PATENT DOCUMENTS

| | | | |
|---|---|---|---|
| 3,120,347 | 2/1964 | Duke | 239/332 |
| 3,173,584 | 3/1965 | Giavasis | 222/333 |
| 3,255,967 | 6/1966 | Kenney | 239/332 |
| 3,901,449 | 8/1975 | Bochmann | 239/332 |
| 3,993,250 | 11/1976 | Shure | 239/333 |
| 4,154,375 | 5/1979 | Bippus | 222/325 |
| 4,187,959 | 2/1980 | Pelton | 222/333 |
| 4,693,423 | 9/1987 | Roe et al. | 239/332 |
| 4,790,454 | 12/1988 | Clark et al. | 239/332 |
| 5,150,841 | 9/1992 | Silvenis et al. | 239/332 |
| 5,303,867 | 4/1994 | Peterson | 239/333 |
| 5,397,034 | 3/1995 | Wunsch | 222/333 |

*Primary Examiner*—Andres Kashnikow
*Assistant Examiner*—Lisa Ann Douglas
*Attorney, Agent, or Firm*—Vickers, Daniels & Young

[57] ABSTRACT

A battery operated, hand-held fluid dispenser comprises a supply container having a body portion and a narrow neck extending upwardly therefrom. A pump and discharge unit is mounted on the upper end of the neck and comprises a pump diaphragm and pump chamber for pumping liquid from the container to a discharge nozzle. A battery powered pump drive unit is removably mounted on the container and comprises an electric motor having an output shaft coupled with the pump diaphragm to displace the latter through a pump stroke when the motor is energized. The pump drive unit is interconnected with the pump and discharge unit and with the body portion of the container and either alone or together with the neck provides a handle for holding the container during a dispensing operation. Removability of the pump drive unit provides for the latter to be usable with supply containers having different fluids to be dispensed.

44 Claims, 7 Drawing Sheets

BATTERY OPERATED FLUID DISPENSER

BACKGROUND OF THE INVENTION

This invention relates to the art of hand-held fluid dispensers and, more particularly, to improvements in a battery operated, hand-held fluid dispenser.

Battery operated, motorized fluid dispensers are known and are shown for example in U.S. Pat. No. 4,154,375 to Bippus and U.S. Pat. No. 5,150,841 to Silvenis et al. In such prior dispensers, an electric motor is selectively connected to a battery source such as by a push button switch and, when energized, the motor operates a pump mechanism by which fluid in a supply container associated with the dispenser is pumped through a discharge opening. Such prior battery operated dispensers have a number of disadvantages, none the least of which is the fact that the pumping mechanism and the battery operated pump driving mechanism are an integral unit mountable on or incorporated in the supply container. Accordingly, the dispenser is not interchangeable with supply containers having different fluids to be dispensed in that there is cross contamination when the dispenser is changed from one supply container to another having a different liquid content, at least until such time as the previous fluid in the dip tube and pump components is flushed out by the fluid in the second container. Furthermore, the pumping mechanisms require either a long flow path between the pump outlet and the discharge opening of the dispenser and/or travel of the fluid along a path to the discharge opening which includes a number of sharp bends. Such flow path length and/or configuration results in a reduction of the velocity of the fluid exiting the discharge opening and, thus, reduces the distance of projection of the discharged fluid. Moreover, if the discharge is in spray form both the distance and breadth of the spray are reduced as a result of the reduction in velocity. Still further, the pumping mechanisms in battery operated dispensers heretofore available are structurally complex and subject to considerable wear during use and this, together with the flow discharge configurations, provides for the dispensers to be relatively expensive to manufacture and to have a shorter life span than is desirable. With further regard to cost, should either the pumping mechanism or the drive motor therefor become inoperable, the entire dispensing device must be replaced as a result of the integrally constructed nature thereof.

SUMMARY OF THE INVENTION

In accordance with the present invention, battery operated fluid dispensers are provided by which the foregoing and other disadvantages of such dispensers heretofore available are advantageously minimized or overcome. More particularly, a battery operated fluid dispenser in accordance with the present invention comprises separate fluid pumping and pump driving units mountable on a supply container, whereby the pump drive unit can be selectively mounted on a number of containers having different fluid contents. In this respect, each container has its own pumping unit mounted thereon, thus avoiding the cross contamination of fluids resulting from the use of structurally integral pump and pump driving assemblies with containers containing different fluid. Further in this respect, the fluid pumping unit can be permanently mounted on the supply container, whereby a user upon dispensing the contents of the fluid container retains the pump driving unit for attachment to a replacement container and pumping unit which can have the same or a different fluid than the one previously used. Alternatively, the pumping unit can be removably secured on the supply container, whereby the pumping unit can be removed and the container refilled with the same fluid previously contained therein. In either event, the arrangement of supply container, pumping unit and pump driving unit in accordance with the present invention advantageously provides a versatility heretofore unattainable in connection with such dispensers.

In accordance with a further aspect of the present invention, a structurally simple pumping mechanism is employed which is in line with the discharge opening of the dispenser, thus providing both a short discharge flow path for the fluid dispensed and a straight discharge flow path from the pump to the discharge opening. Thus, for a given pump displacement, the distance of fluid discharged is optimized as is the breadth of a spray pattern if the discharge is in spray form. In accordance with yet another aspect of the invention, the pump-driving arrangement is simplified and, preferably, includes an electric motor having an output shaft coaxial with the pump and carrying a cam which is cooperable with an aligned cam on the movable component of the pump such that rotation of the motor output shaft is translated into axially displacement of the movable pump element. Thus, the drive arrangement is structurally simple and durable, lending both to the economical production of the sprayer as well as a prolonged life with respect to use thereof. Preferably, the movable pump element is an axially rollable diaphragm of a suitable rubber material having a reentrant portion to which the corresponding cam is attached and which reentrant portion is displaced in opposite directions to provide the suction and discharge strokes of the pump. The diaphragm arrangement advantageously minimizes resistance to displacement of the pump element during pumping, such as is experienced for example in connection with piston and cylinder arrangements, gear-drive arrangements and the like, and therefore advantageously reduces the load on the pump drive motor increasing both the life thereof and that of the batteries by which the motor is operated.

It is accordingly an outstanding object of the present invention to provide improvements in connection with the construction of battery operated fluid dispensers.

Another object is the provision of a fluid dispenser of the foregoing character which is operable in conjunction with supply containers having different fluids in a manner which avoids cross-contamination between the different fluids.

Yet another object is the provision of a fluid dispenser of the foregoing character in which the pumping mechanism provides a short, straight discharge path for the fluid dispensed whereby, for a given pump displacement, the distance of fluid discharge and the breadth of a spray pattern discharge are optimized.

Still a further object is the provision of a fluid dispenser of the foregoing character in which the pump and pump driving components are structurally simple and durable, whereby the dispenser is economical to produce and efficient in operation while minimizing wear with respect to the component parts thereof thus prolonging the life of the dispenser as well as the life of the batteries by which the dispenser is operated.

Another object is the provision of a fluid dispenser of the foregoing character having structurally separate pumping and pump drive units interrelated with a supply container such that the pump driving unit is interchangeable with supply containers having different fluid contents.

BRIEF DESCRIPTION OF THE DRAWINGS

The foregoing objects, and others, will in part be obvious and in part pointed out more fully hereinafter in conjunction with the written description of the preferred embodiments of the invention illustrated in the accompanying drawings in which.

DESCRIPTION OF PREFERRED EMBODIMENTS

Figure 1:
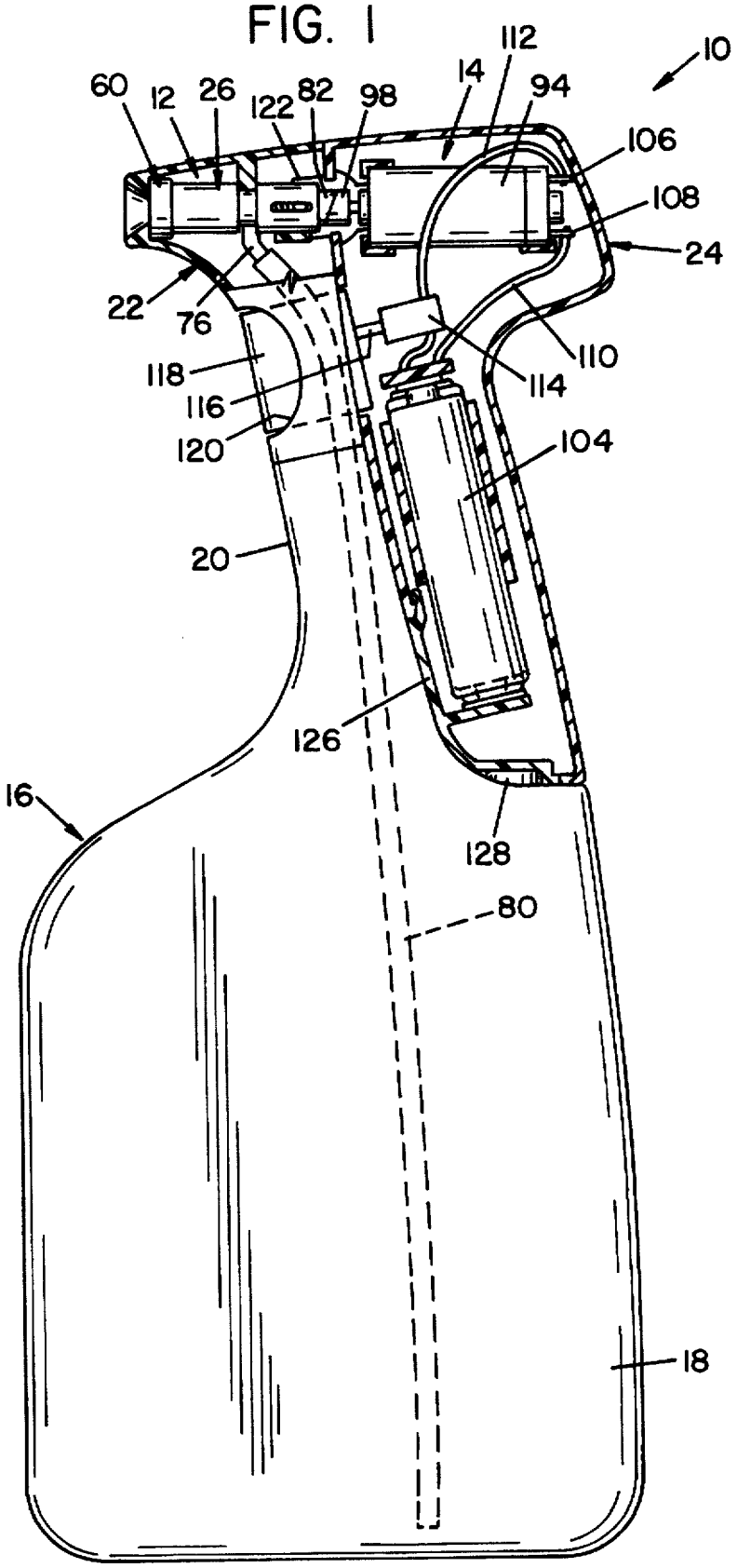
FIG. 1 is a side elevation view, partially in section, of a liquid dispenser in accordance with the invention.
Figure 2:
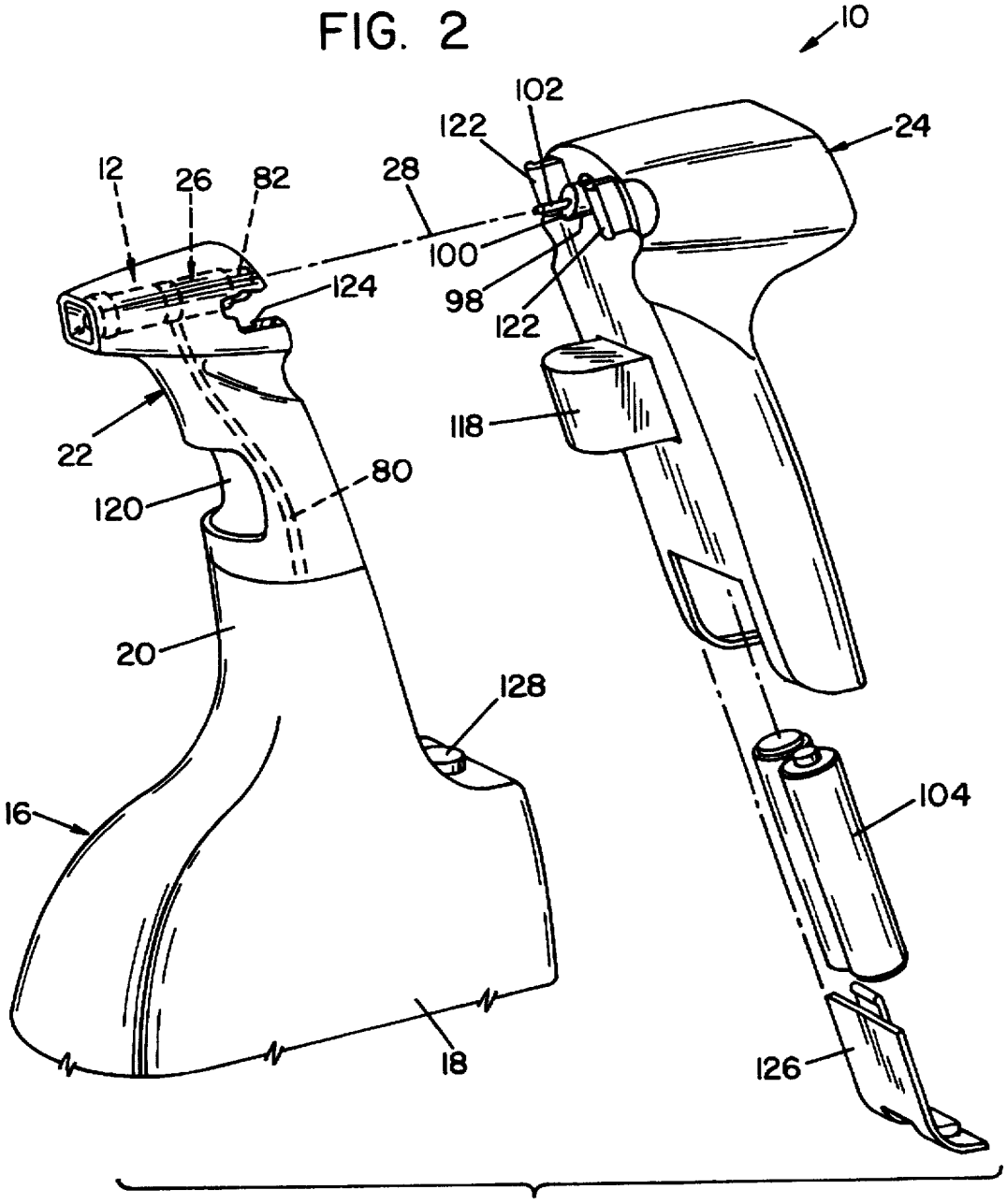
FIG. 2 is an exploded perspective view of the component parts of the dispenser illustrated in FIG. 1.

Referring now in greater detail to the drawings, wherein the showings are for the purpose of illustrating preferred embodiments of the invention only and not for the purpose of limiting the invention, FIGS. 1–5 illustrate a fluid dispenser 10 comprising a pumping unit 12 and a pump driving unit 14 mounted on a supply container 16. Container 16 includes a lower body portion 18 and a narrow neck portion 20 extending upwardly therefrom, and pumping unit 12 and pump drive unit 14 are respectively enclosed in housings 22 and 24 contoured to provide a desired spray head profile with one another and with adjacent portions of container 16. Preferably, housing 22 and the pumping components therein are permanently attached to the upper end of neck 20 of container 16, and housing 24 and the pump drive components enclosed therein are detachably interconnected with housing 22 and the upper end of body portion 18 of container 16 as set forth more fully hereinafter.

Figure 3:
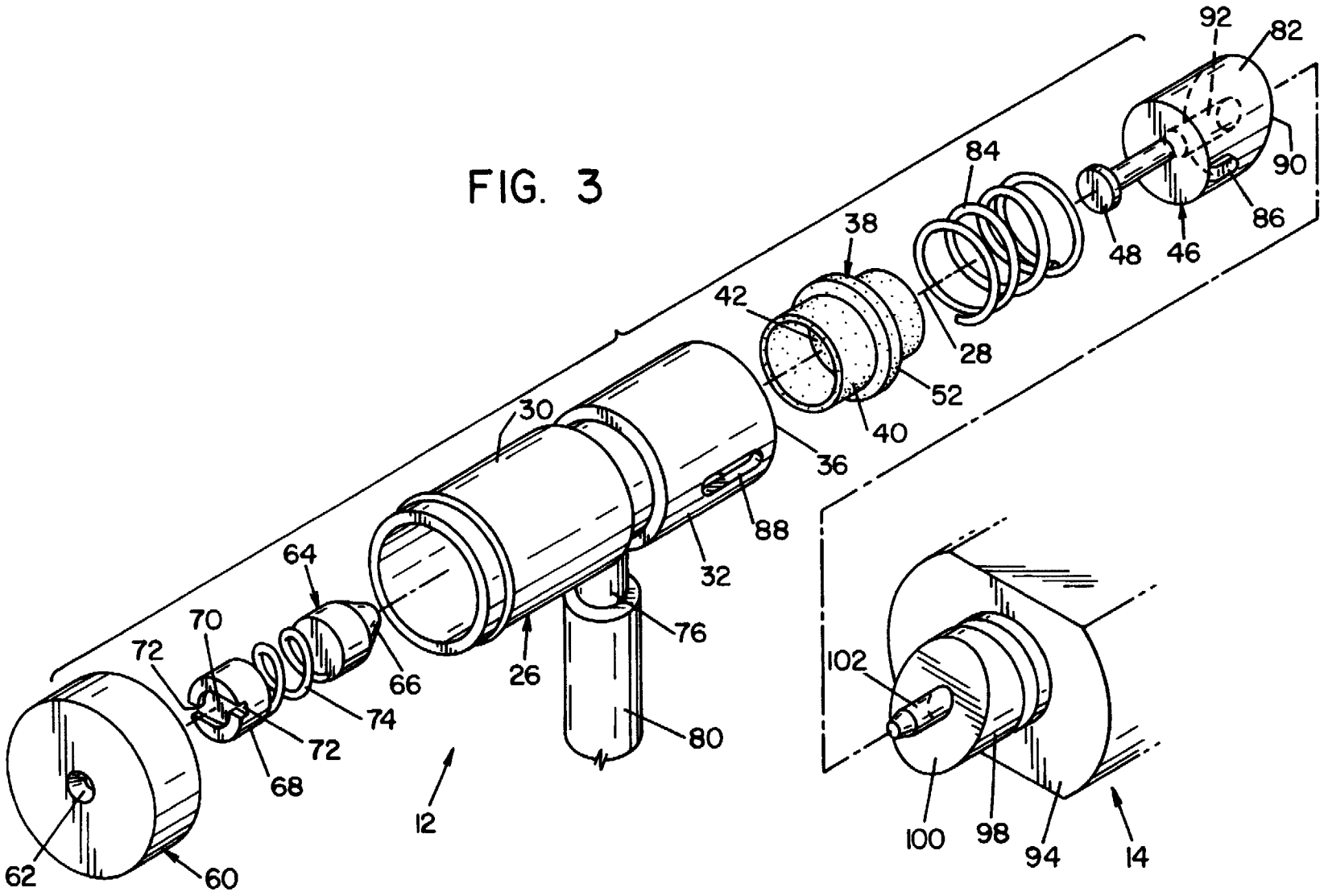
FIG. 3 is an exploded perspective view of the component parts of the pumping and pump driving units.
Figure 4:
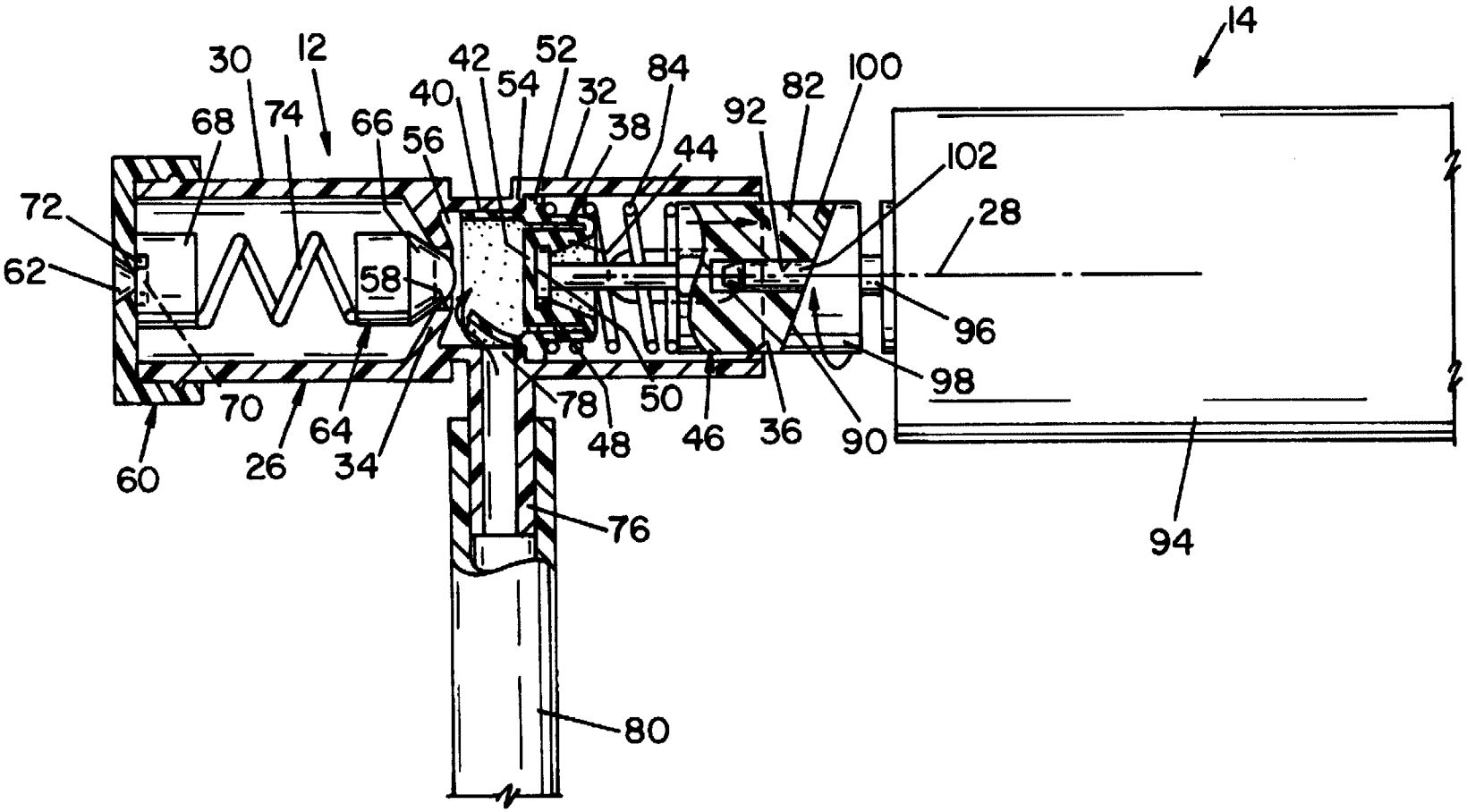
FIG. 4 is a sectional elevation view showing the pumping and pump driving components in the position thereof following the suction stroke of the pump.
Figure 5:
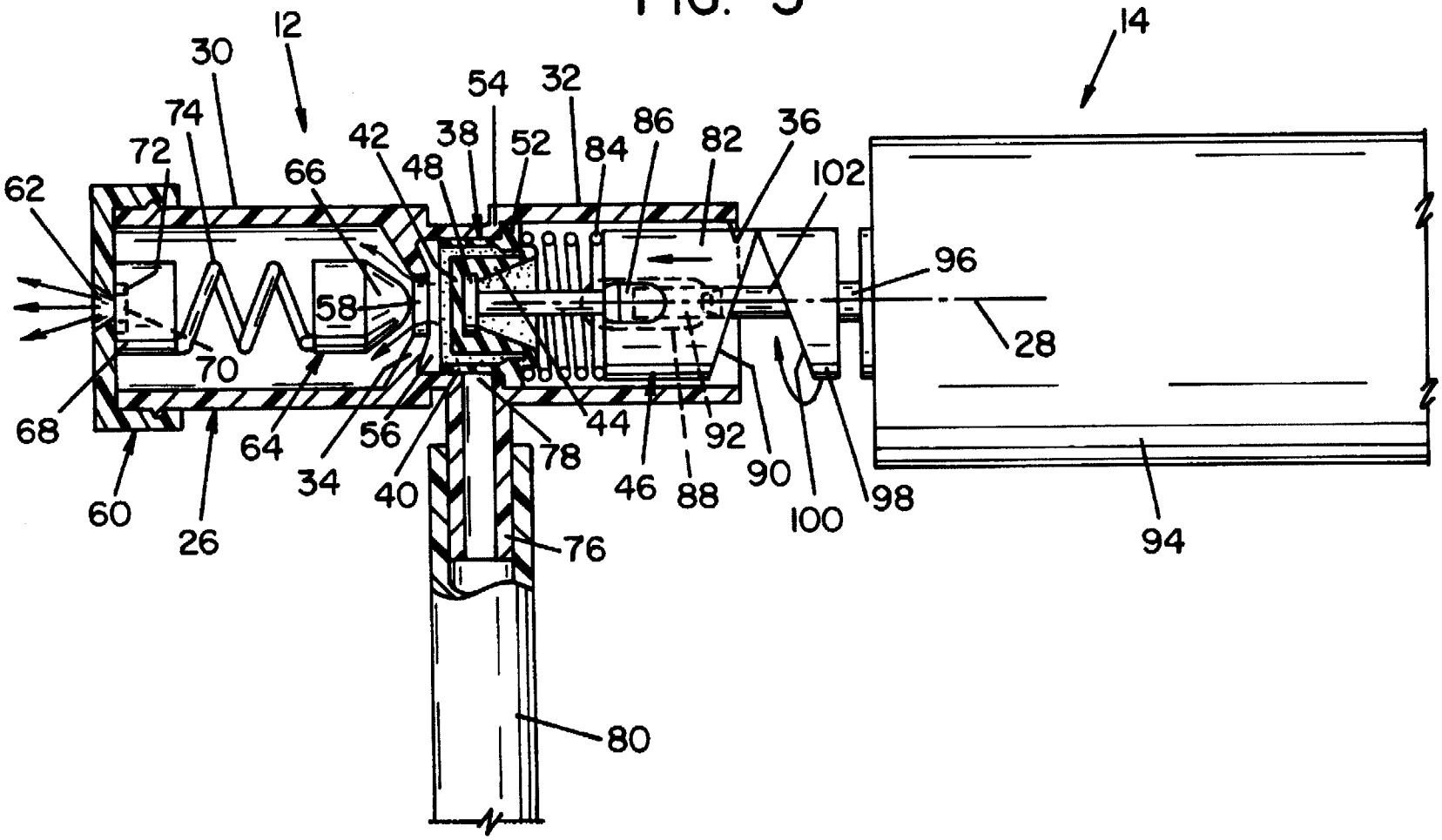
FIG. 5 is a sectional elevation view showing the pumping and pump driving components in the positions thereof following the discharge stroke of the pump.

As best seen in FIGS. 3–5, pumping unit 12 includes a cylindrical body member 26 having an axis 28 and providing an axially outer discharge tube portion 30 and an axially inner pump portion 32, which portions 30 and 32 are separated internally of member 26 by a radially inwardly extending peripheral wall 34 therebetween. The pump for the dispenser includes a pump cylinder defined by the interior of portion 32 and having a front end defined by wall 34 and an open rear end 36. The pump further includes a pump diaphragm 38 of suitable rubber material having a circular wall portion 40 received in the pump chamber and providing an open diaphragm end adjacent front wall 34 of the chamber. The pump diaphragm further includes a closed outer end defined by an end wall 42 transverse to axis 28 and a reentrant portion 44 of the side wall of the diaphragm. A pump diaphragm actuator element 46 has an inner end 48 received in an annular recess 50 in the reentrant portion of the diaphragm such that end wall 42 is axially displaceable with actuator member 46 as will become apparent hereinafter. Diaphragm 38 includes a radially outwardly extending peripheral flange 52 intermediate the opposite ends thereof which abuts against a radially inwardly extending peripheral shoulder 54 of pump portion 32 of body member 26 to axially position the inner end of diaphragm wall 40 relative to front wall 34 of the pump cylinder. Wall 34 and diaphragm 38 cooperatively provide a variable volume pump chamber 56.

Wall 34 includes an outlet opening 58 coaxial with axis 28, and the axially outer end of discharge tube portion 30 of body member 26 receives and supports a nozzle component 60 having a discharge outlet 62 coaxial with axis 28 and through which fluid from container 16 is pumped as will become apparent hereinafter. A discharge control valve element 64 is reciprocally supported in discharge tube portion 30 and has an inner end 66 adapted to move axially relative to opening 58 between engaged and disengaged positions relative to the axially outer edge of the opening which provides a valve seat for valve element 64. A spinner element 68 abuts against the inner side of nozzle member 60 and has an outer end coaxial with axis 28 and provided in a well known manner with an axially inwardly extending recess 70 and ports 72 opening laterally thereinto so as to impart a swirling motion to fluid pumped through outlet tube portion 30 and thence through discharge opening 62. A biasing spring 74 is disposed between valve element 64 and spinner element 68 and, preferably, is integral therewith. Accordingly, it will appreciated that displacement of valve element 64 to the left from its position shown in FIG. 4 to its position shown in FIG. 5 is against the bias of spring 74, and such displacement of the valve element is responsive to fluid pressure in pump chamber 56. Upon displacement of the valve element from engagement with the valve seat, fluid flows across the valve element and thence through discharge tube portion 30 to spinner element 68, laterally inwardly through ports 72 to recess 70 and thence through discharge opening 62.

Body member 26 further includes an inlet conduit 76 integral with and extending downwardly therefrom, and an inlet opening 78 in the pump cylinder wall which communicates the interior of tube 76 with pump chamber 56. The lower end of inlet tube 76 receives the upper end of a dip tube 80 which extends downwardly into supply container 16 for delivering fluid from the container to the pump chamber during operation of the sprayer. The axially inner end of pump diaphragm wall 40 overlies inlet opening 78 and provides a check valve which permits fluid to enter pump chamber 56 from supply container 16 during the suction stroke of the pump and precludes the flow of fluid in pump chamber 56 through inlet opening 78 during the discharge stroke of the pump.

As mentioned hereinabove, axially inner end 48 of diaphragm actuator 46 interengages with the reentrant portion of pump diaphragm 38 such that movable end 42 of the pump diaphragm is axially displaceable with the actuator member. As will be appreciated from FIGS. 4 and 5 of the drawing, actuator 46 and thus diaphragm end 42 are axially displaceable toward and away from pump chamber wall 34. As will be further appreciated from the latter figures, displacement of diaphragm end 42 from the position shown in FIG. 4 to the position shown in FIG. 5 provides the discharge stroke for the pump, and displacement of the diaphragm end from the position shown in FIG. 5 to the position shown in FIG. 4 provides the suction stroke for the pump. The axially outer end of diaphragm actuator 46 is provided with a cam member 82 by which the actuator and thus diaphragm end 42 are displaced from the position shown in FIG. 4 to the position shown in FIG. 5 as described in greater detail hereinafter, and a compression spring 84 is provided between diaphragm flange 52 and the axially inner end of cam 82 to bias actuator 46 and thus diaphragm end 42 to the position shown in FIG. 4. As will be appreciated from FIG. 3, cam member 82 is provided with a radially outwardly extending projection 86 which is received in an axially extending opening 88 in pump cylinder portion 32 of body member 26. Projection 86 is axially slidable in opening 88 and engages the axially outer end thereof to limit displacement of actuator 46 and thus diaphragm end 42 to the right in FIG. 4 under the influence of biasing spring 84. For the purpose set forth hereinafter, the axially outer end of cam member 82 is provided with a planar cam surface 90 at an angle to axis 28 and with an axially inwardly extending bore 92 coaxial with axis 28.

Pump drive unit 14 comprises an electric motor 94 having a rotatable output shaft 96 which is coaxial with axis 28 when the pump drive unit including housing 24 is mounted on supply container 16 in operative relationship with pumping unit 12. The outer end of shaft 96 is provided with a cam member 98 which is suitably secured to shaft 96 for rotation therewith. The axially outer end of cam member 98 is provided with a planar cam surface 100 disposed at an angle to axis 28 and which angle corresponds to that of surface 90 of cam member 82. Cam member 98 further includes a circular projection 102 coaxial with axis 28. Projection 102 extends axially outwardly from cam surface 100 and is axially slidably and rotatably received in bore 92 in cam member 82 for the purpose set forth hereinafter. As will be appreciated from FIGS. 1 and 2 of the drawing, housing 24 of pump drive unit 14 encloses a power supply for motor 94 which, in the embodiment disclosed, comprises a battery pack 104 having positive and negative terminals, not designated numerically, connected to motor terminals 106 and 108 by lines 110 and 112 and a control switch 114 in line 112. Switch 114 is a push-button type switch having an operating stem 116 extending therefrom and provided on its outer end with an operating or trigger member 118 by which the switch is actuated as will become apparent hereinafter. Switch 114 is normally open and is closed by displacing trigger member 118 to the right from the position thereof shown in FIG. 1. When closed, switch 114 connects motor 94 across battery pack 104, whereby the motor is energized to rotate output shaft 96 thereof and thus cam member 98 on the outer end of the shaft. As will be appreciated from FIGS. 4 and 5 of the drawing, rotation of cam member 98 180° from the position shown in FIG. 4 to the position shown in FIG. 5 axially displaces cam member 82 and thus pump diaphragm wall 42 through the discharge stroke thereof against the bias of return spring 84. Rotation of cam member 98 180° from the position shown in FIG. 5 to the position shown in FIG. 4 provides for cam 82 and thus pump diaphragm wall 42 to return to their initial positions under the influence of biasing spring 84 to provide the suction stroke of the pump. During rotation of cam 98 and axial reciprocation of cam member 82 resulting therefrom, projection 102 and bore 92 interengage to preclude relative lateral displacement between the cam members, thus to maintain the coaxial relationship therebetween.

It will appreciated that motor shaft 96 rotates continuously when switch 114 is closed whereby the pump continuously cycles through the discharge and suction strokes thereof so as to pump liquid from container 16 through discharge opening 62 until such time as the user releases switch trigger 118.

In the embodiment illustrated in FIGS. 1–5 of the drawing, housing 22 of pumping unit 12 is preferably permanently secured to upper portion 20 of the supply container so as to provide a disposable unit therewith, and housing 24 of pump drive unit 14 is detachably secured to upper portion 20 of the container and to housing 22 such that the pump drive unit is separable therefrom and reusable with a replacement supply container and pumping assembly. More particularly in this respect, switch trigger 118 is incorporated with switch 114 in housing 24 for displacement therewith, and housing 22 is provided with an opening 120 in which the trigger is disposed when pump drive unit 14 is in assembled relationship with respect to pumping unit 12 and container 16. Further in this respect, the upper ends of housings 22 and 24 are provided on laterally opposite sides of axis 28 with interengaging latch and keeper arrangements including latch components 122 on housing 24 and corresponding keeper components 124 on housing 22, only one of the latter of which is visible in FIG. 2 of the drawing. Further, the lower end of housing 24 includes a removable cover member 126 for providing access to the interior of housing 24 for replacement of batteries 104, and the lower end of cover member 126 is contoured for sliding engagement with a projection 128 on supply container 16 to laterally stabilize the lower end of housing 24 when the later is in assembled relationship with container 16 and pumping unit 12. As will be appreciated from FIG. 1, when pump drive unit 14 is in assembled relationship with container 16 and pumping unit 12 the lower end of housing 22 of the latter unit, upper portion 20 of the supply container and the lower portion of housing 24 of pump drive unit 14 cooperatively provide a handle by which the sprayer is adapted to be grasped by a user such that trigger 118 is depressible by the user's forefinger.

Figure 6:
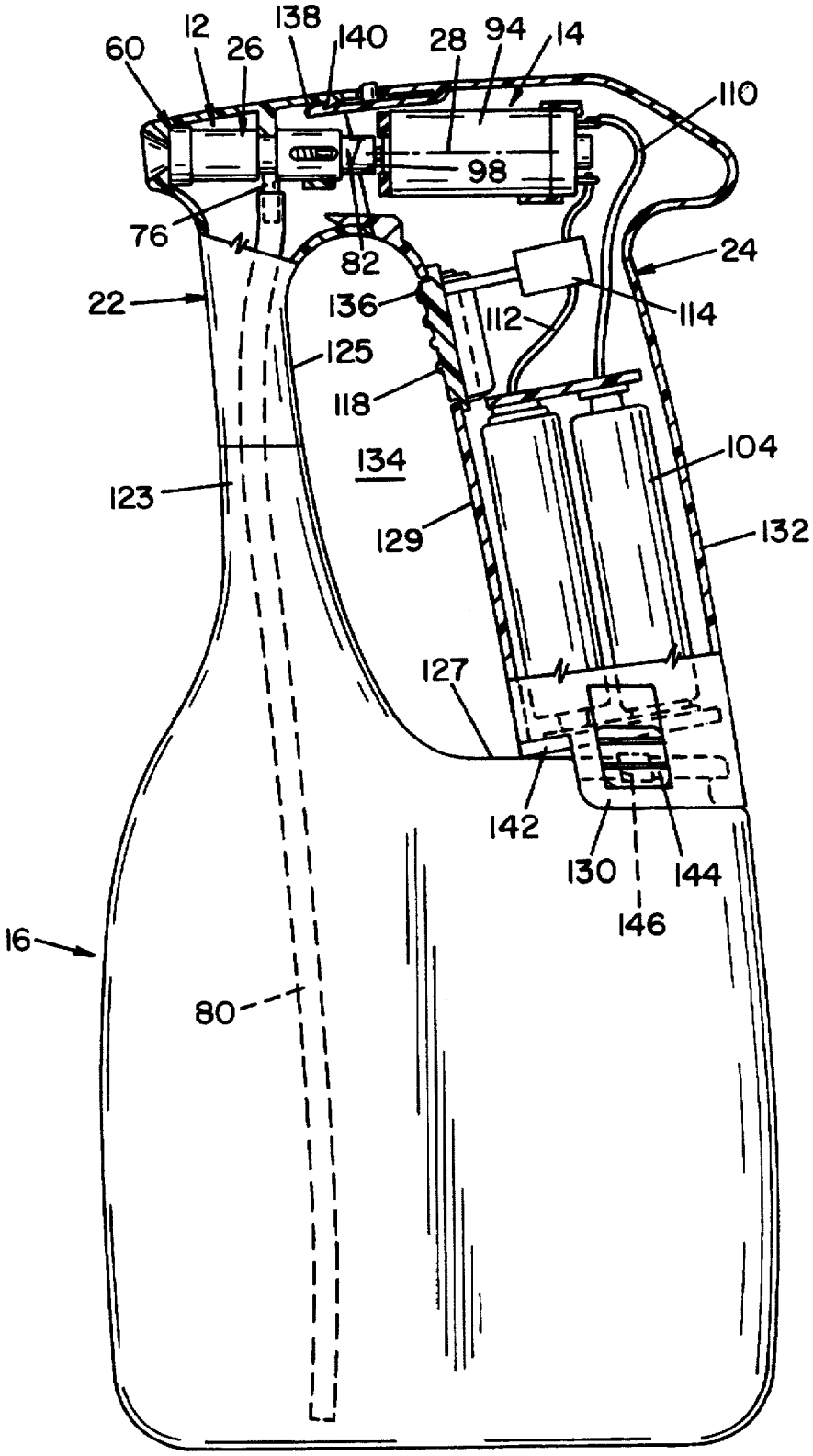
FIG. 6 is a side elevation view, partially in section, of another embodiment of a fluid dispenser according to the invention.
Figure 7:
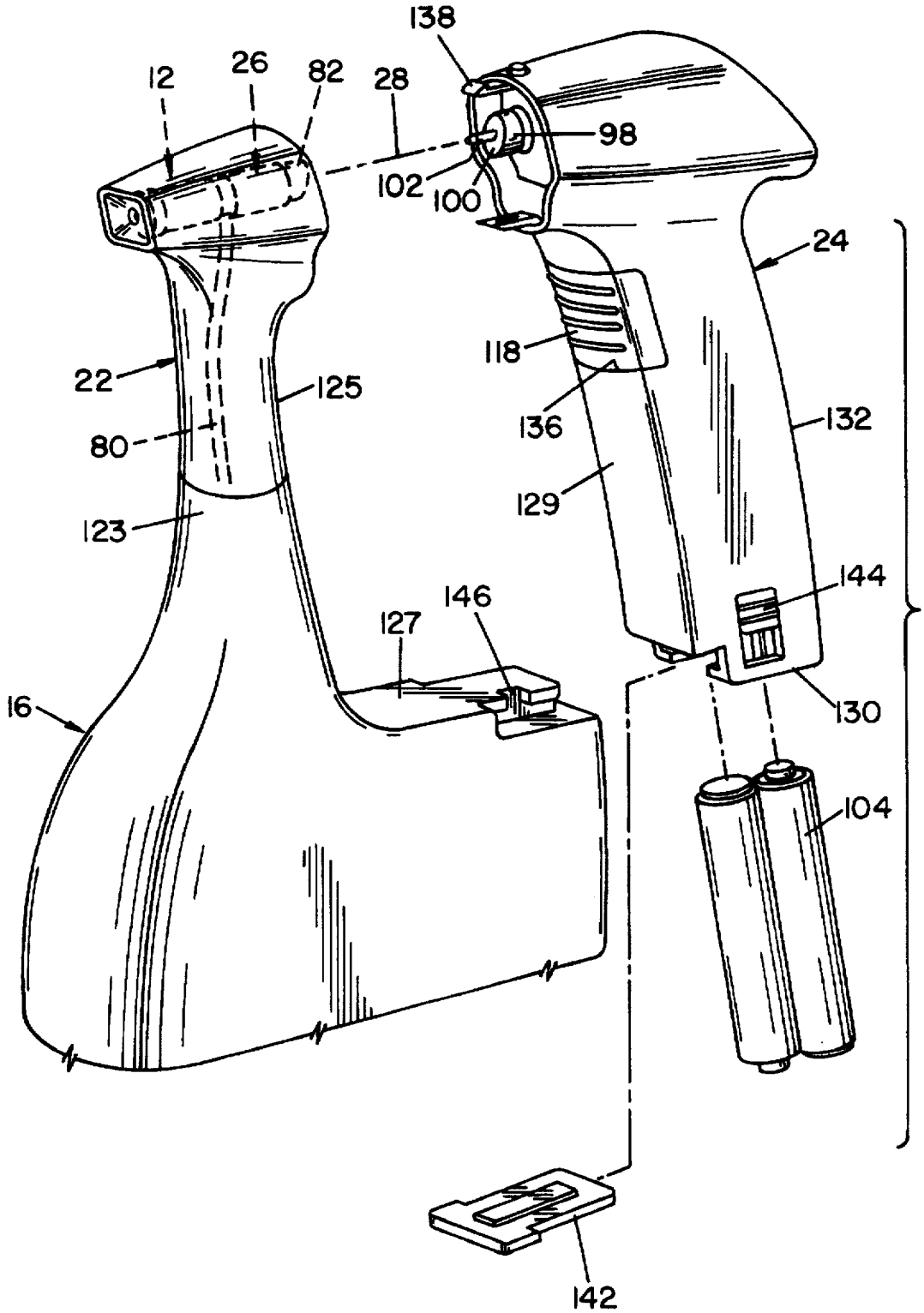
FIG. 7 is an exploded perspective view of the component parts of the dispenser shown in FIG. 6.

FIGS. 6 and 7 of the drawing illustrate a modification of the structures of the supply container, pumping unit housing and pump drive unit housing which provide a sprayer in which the handle portion is defined by the pump drive unit housing alone. In this embodiment, the structures of the pumping unit and the pump drive unit are the same as that described hereinabove in conjunction with FIG. 1–5, whereby like numerals are employed in FIG. 6 and 7 to designate component parts which correspond to those illustrated in FIGS. 1–5. In the embodiment illustrated in FIGS. 6 and 7, supply container 16 is modified to provide a narrow upper end 123 which is closer to the front end of the supply container than the upper end in the earlier embodiment, and the lower body portion of the container includes a vertically stepped upper wall 127 which extends generally horizontally inwardly from the rear end of the container and thence arcuately upwardly to provide the inner side of upper end 123 of the supply container 16. The lower end of housing 22 for pumping unit 12 is contoured to provide an inner side 125 which extends upwardly from the upper end of wall 127 of the supply container and then arcuately rearwardly so as to blend with an inner wall portion 129 of housing 24 for pump drive unit 14. The latter housing includes a lower end 130 overlying stepped container wall 127 and releasably interengaged therewith as described hereinafter and an outer wall 132 extending upwardly from the outer end of container wall 127. This profile provides a hand opening 134, and housing 24 of pump drive unit 14 provides a handle by which the sprayer can be grasped by a user. Switch trigger 118 is received in an opening 136 therefor in housing 24 and is adapted to be depressed by the forefinger of a person holding the sprayer.

Preferably, as in the earlier embodiment, housing 22 of pumping unit 12 is permanently secured to upper end 123 of supply container 16, and housing 24 of pump drive unit 14 is detachably secured to the upper end of housing 22 and to stepped wall 127 of container 16 to provide for the pump drive unit to be removably mounted relative to the supply container and pumping unit. Further in this respect, the upper ends of housings 22 and 24 are provided with an interengaging latch and keeper arrangement which includes a latch member 138 on housing and a keeper component 140 on housing 22. Further in accordance with this embodiment, lower end 130 of housing 24 is provided with a horizontally slidable cover 142 providing access to the interior of housing 24 for the purpose of battery replacement, and the lower end of housing 24 and wall 127 of container 16 are provided with a latch and keeper arrangement including a latch component 144 on housing 24 and a keeper component 146 on container wall 127.

While considerable emphasis has been placed herein on the structures and structural interrelationships between the component parts of the preferred embodiments of the present invention, it will be appreciated that other embodiments can be made and that many changes can be made in the preferred embodiments without departing from the principles of the invention. In particular in this respect, it will be appreciated that the housing of the pump and discharge unit can be removably interconnected with the upper end of the supply container, thus enabling refilling thereof. Furthermore, the pump member can be provided other than by the preferred diaphragm component and, for example, could be in the form of a reciprocable piston, an axially collapsible bellows member or the like. Moreover, arrangements other than the preferred cam arrangement can be devised for translating rotation of the pump motor into reciprocation of the pump member. The foregoing and other modifications of the preferred embodiment as well as other embodiments of the invention will be obvious or suggested to those skilled in the art, whereby it is to be distinctly understood that the foregoing descriptive matter is to be interpreted merely as illustrative of the invention and not as a limitation.

It is claimed:

1. A battery operated sprayer for a fluid supply container comprising, means providing a discharge opening having an axis, variable volume pump means having a pump axis parallel to said axis of said discharge opening and having axially spaced apart fixed and movable end means, said fixed end means facing said discharge opening, means providing an inlet for connecting said pump means with fluid in said supply container, means providing an outlet for connecting said pump means with said discharge opening, means including electric motor means for axially displacing said movable end means toward and away from said fixed end means for pumping fluid from said container through said outlet and discharge opening, battery means for operating said motor means, and manually operable switch means for selectively connecting and disconnecting said motor means and said battery means.

2. A sprayer according to claim 1, wherein said pump axis is coaxial with said axis of said discharge opening.

3. A sprayer according to claim 1, wherein said motor means includes an output shaft rotatable about a motor axis parallel to said pump axis, and said means for axially displacing said movable end means includes means for translating rotation of said output shaft to axial reciprocation of said movable end means.

4. A sprayer according to claim 3, wherein said motor axis is coaxial with said pump axis.

5. A sprayer according to claim 4, wherein said motor axis and pump axis are coaxial with said axis of said discharge opening.

6. A sprayer according to claim 3, wherein said means for translating rotation includes cam means rotatable with said drive shaft and cam follower means on said movable end means.

7. A sprayer according to claim 1, wherein said pump means includes a cylinder coaxial with said pump axis and having axially opposite ends, an end wall at one of said ends and the other of said ends being open, a cylindrical pump member coaxial with said pump axis and having open and closed ends and flexible wall means between said ends thereof, said open end of said pump member being in said cylinder adjacent said end wall thereof, and said means for axially displacing said movable end means including actuator means connected to said closed end of said pump member.

8. A battery operated sprayer for a fluid supply container comprising, means providing a discharge opening having an axis, variable volume pump means having a pump axis parallel to said axis of said discharge Opening and having axially spaced apart fixed and movable end means, said fixed end means facing said discharge opening, means providing an inlet for connecting said pump means with fluid in said supply container, means providing an outlet for connecting said pump means with said discharge opening, means including electric motor means for axially displacing said movable end means toward and away from said fixed end means for pumping fluid from said container through said outlet and discharge opening, battery means for operating said motor means, and manually operable switch means for selectively connecting and disconnecting said motor means and said battery means, said motor means including an output shaft rotatable about a motor axis parallel to said pump axis, said means for axially displacing said movable end means including means for translating rotation of said output shaft to axial reciprocation of said movable end means, said means for translating rotation including cam means rotatable with said drive shaft and cam follower means on said movable end means, said cam means including a cam face in a plane intersecting said motor axis at an angle thereto, and said cam follower means including a follower surface in a plane intersecting said pump axis at an angle thereto.

9. A sprayer according to claim 8, and means axially slidably interengaging said cam means and said cam follower means against relative lateral displacement therebetween.

10. A sprayer according to claim 8, wherein said means for axially displacing said movable end means further includes spring means biasing said cam follower means axially toward said cam means.

11. A battery operated sprayer for a fluid supply container comprising, means providing a discharge opening having an axis, variable volume pump means having a pump axis parallel to said axis of said discharge opening and having axially spaced apart fixed and movable end means, said fixed end means facing said discharge opening, means providing an inlet for connecting said pump means with fluid in said supply container, means providing an outlet for connecting said pump means with said discharge opening, means including electric motor means for axially displacing said movable end means toward and away from said fixed end means for pumping fluid from said container through said outlet and discharge opening, battery means for operating said motor means, manually operable switch means for selectively connecting and disconnecting said motor means and said battery means, said pump means including a cylinder coaxial with said pump axis and having axially opposite ends, an end wall at one of said ends and the other of said ends being open, a cylindrical pump member coaxial with said pump axis and having open and closed ends and flexible wall means between said ends thereof, said open end of said pump member being in said cylinder adjacent said end wall thereof, said means for axially displacing said movable end means including actuator means connected to said closed end of said pump member, and said closed end of said pump member including an end wall transverse to said pump axis and a reentrant portion of said flexible wall means integral with said end wall.

12. A sprayer according to claim 11, wherein said actuator means includes an actuator end received in said reentrant portion of said wall means, and said actuator end and said reentrant portion including means interengaging for axial displacement of said actuator means in opposite directions to axially roll said flexible wall means relative to said actuator end.

13. A sprayer according to claim 12, wherein said motor means includes an output shaft rotatable about a motor axis parallel to said pump axis, and said means for axially displacing said actuator means includes means for translating rotation of said output shaft to axial reciprocation of said actuator means.

14. A sprayer according to claim 13, wherein said means for translating rotation includes cam means rotatable with said drive shaft and cam follower means on said actuator means.

15. A sprayer according to claim 14, wherein said cam means includes a cam face in a plane intersecting said motor axis at an angle thereto, and said cam follower means includes a follower surface in a plane intersecting said pump axis at an angle thereto.

16. A sprayer according to claim 15, wherein said means for axially displacing said movable end means further includes spring means biasing said actuator means axially toward said cam means.

17. A sprayer according to claim 16, and means axially slidably interengaging said cam means and said cam follower means against relative lateral displacement therebetween.

18. A sprayer according to claim 17, wherein said motor axis, said pump axis and said axis of said discharge opening are coaxial.

19. A battery operated sprayer for a fluid supply container comprising, a pump and discharge unit mountable on said supply container and including means providing a discharge opening, pump means, means providing an inlet for connecting said pump means with fluid in said supply container, and means providing an outlet for connecting said pump means with said discharge opening, and a pump drive unit separate from said pump and discharge unit and having mounted and dismounted positions on said supply container relative to said pump and discharge unit, said pump drive unit including electric motor means, battery means for operating said motor means, and switch means for selectively connecting and disconnecting said motor means and said battery means, and said motor means and pump means in said mounted position of said pump drive unit including means interengaging for said motor means to operate said pump means for pumping fluid from said container through said discharge opening when said switch means connects said motor means and said battery means.

20. A sprayer according to claim 19, wherein said supply container has a body portion and a neck extending upwardly therefrom and having an open upper end, said pump and discharge unit being mounted on said open upper end, and means for releasably interengaging said pump drive unit and said pump and discharge unit in said mounted position of said pump drive unit.

21. A sprayer according to claim 20, wherein said pump drive unit in said mounted position provides a handle for supporting said sprayer.

22. A sprayer according to claim 21, wherein said handle is spaced from said neck.

23. A sprayer according to claim 20, wherein said pump means has a generally horizontal pump axis and axially spaced apart fixed and movable end means, said fixed end means facing said discharge opening, said motor means having an output shaft parallel to said pump axis, and said means interengaging for said motor means to operate said pump means including means on said output shaft and means on said movable end means of said pump means.

24. A sprayer according to claim 20, wherein said output shaft is rotatable and said means on said output shaft and said means on said movable end means interengage for translating rotation of said output shaft to axial displacement of said movable end means.

25. A sprayer according to claim 23, wherein said pump means includes a cylinder coaxial with said pump axis and having axially opposite ends, an end wall at one of said ends, and the other of said ends being opens said end wall providing said fixed end means of said pump means, a cylindrical pump member coaxial with said pump axis and having open and closed ends and flexible wall means between said ends thereof, said closed end providing said movable end means of said pump means, and said open end of said pump member being in said cylinder adjacent said end wall thereof.

26. A battery operated sprayer for a fluid supply container comprising, a pump and discharge unit mountable on said supply container and including means providing a discharge opening, pump means, means providing an inlet for connecting said pump means with fluid in said supply container, and means providing an outlet for connecting said pump means with said discharge opening, and a pump drive unit separate from said pump and discharge unit and having mounted and dismounted positions on said supply container relative to said pump and discharge unit, said pump drive unit including electric motor means, battery means for operating said motor means, and switch means for selectively connecting and disconnecting said motor means and said battery means, said motor means and pump means in said mounted position of said pump drive unit including means interengaging for said motor means to operate said pump means for pumping fluid from said container through said discharge opening when said switch means connects said motor means and said battery means, said supply container having a body portion and a neck extending upwardly therefrom and having an open upper end, said pump and discharge unit being mounted on said open upper end, means for releasably interengaging said pump drive unit and said pump and discharge unit in said mounted position of said pump drive unit, and said pump drive unit including a housing having upper and lower housing portions, said upper and lower housing portions in said mounted position of said pump drive unit having means respectively releasably interengaging said upper housing portion with said pump and discharge unit and releasably interengaging said lower housing portion with said body portion of said supply container.

27. A sprayer according to claim 26, wherein said lower housing portion is spaced from said neck to provide a handle for supporting said sprayer.

28. A sprayer according to claim 26, wherein said lower housing portion is adjacent said neck and said neck and lower housing portion together provide a handle for supporting said sprayer.

29. A sprayer according to claim 26, wherein said electric motor means is in said upper housing portion, and said battery means and said switch means are in said lower housing portion.

30. A sprayer according to claim 29, wherein said lower housing portion is spaced from said neck to provide a handle for supporting said sprayer, and said switch means includes a switch actuator button extending through an opening therefor in said lower housing portion.

31. A sprayer, according to claim 29 wherein said lower housing portion is adjacent said neck and said neck and lower housing portion together provide a handle for supporting said sprayer, and said switch means includes a switch actuator button extending through an opening therefor in said neck.

32. A battery operated sprayer for a fluid supply container comprising, a pump and discharge unit mountable on said supply container and including means providing a discharge opening, pump means, means providing an inlet for connecting said pump means with fluid in said supply container, and means providing an outlet for connecting said pump means with said discharge opening, and a pump drive unit separate from said pump and discharge unit and having mounted and dismounted positions on said supply container relative to said pump and discharge unit, said pump drive unit including electric motor means, battery means for operating said motor means, and switch means for selectively connecting and disconnecting said motor means and said battery means, said motor means and pump means in said mounted position of said pump drive unit including means interengaging for said motor means to operate said pump means for pumping fluid from said container through said discharge opening when said switch means connects said motor means and said battery means, said supply container having a body portion and a neck extending upwardly therefrom and having an open upper end, said pump and discharge unit being mounted on said open upper end, means for releasably interengaging said pump drive unit and said pump and discharge unit in said mounted position of said pump drive unit, said pump means having a generally horizontal pump axis and axially spaced apart fixed and movable end means, said fixed end means facing said discharge opening, said motor means having an output shaft parallel to said pump axis, said means interengaging for said motor means to operate said pump means including means on said output shaft and means on said movable end means of said pump means, said output shaft being rotatable, said means on said output shaft and said means on said movable end means interengaging for translating rotation of said output shaft to axial displacement of said movable end means, said means on said output shaft being first cam means, and said means on said movable end means being second cam means.

33. A sprayer according to claim 25, wherein said first and second cam means interengage for axially displacing said movable end means of said pump means toward said fixed end means thereof, and spring means axially biasing said movable end means away from said fixed end means.

34. A sprayer according to claim 32, wherein said first cam means includes a cam surface in a plane at an angle to said output shaft and said second cam means includes a cam surface in a plane at an angle to said pump axis.

35. A battery operated sprayer for a fluid supply container comprising, a pump and discharge unit mountable on said supply container and including means providing a discharge opening, pump means, means providing an inlet for connecting said pump means with fluid in said supply container, and means providing an outlet for connecting said pump means with said discharge opening, and a pump drive unit separate from said pump and discharge unit and having mounted and dismounted positions on said supply container relative to said pump and discharge unit, said pump drive unit including electric motor means, battery means for operating said motor means, and switch means for selectively connecting and disconnecting said motor means and said battery means, said motor means and pump means in said mounted position of said pump drive unit including means interengaging for said motor means to operate said pump means for pumping fluid from said container through said discharge opening when said switch means connects said motor means and said battery means, said supply container having a body portion and a neck extending upwardly therefrom and having an open upper end, said pump and discharge unit being mounted on said open upper end, means for releasably interengaging said pump drive unit and said pump and discharge unit in said mounted position of said pump drive unit, said pump means having a generally horizontal pump axis and axially spaced apart fixed and movable end means, said fixed end means facing said discharge opening, said motor means having an output shaft parallel to said pump axis, said means interengaging for said motor means to operate said pump means including means on said output shaft and means on said movable end means of said pump means, said pump means including a cylinder coaxial with said pump axis and having axially opposite ends, an end wall at one of said ends, the other of said ends being open, said end wall providing said fixed end means of said pump means, a cylindrical pump member coaxial with said pump axis and having open and closed ends and flexible wall means between said ends thereof, said closed end providing said movable end means of said pump means, said open end of said pump member being in said cylinder adjacent said end wall thereof, and said closed end of said pump member including an end wall transverse to said pump axis and a reentrant portion of said flexible wall means integral with said end wall.

36. A sprayer according to claim 35, wherein said means on said movable end means includes actuator means having an inner end received in said reentrant portion of said wall means, and said inner end of said actuator means and said end wall of said pump member including means interengaging for axial displacement of said actuator means in opposite directions to axially roll said flexible wall means relative to said actuator means.

37. A sprayer according to claim 36, wherein said output shaft is rotatable and said actuator means has an outer end, and said means on said movable end means includes means on said outer end of said actuator means interengaging with said means on said output shaft for translating rotation of said output shaft to axial displacement of said actuator means.

38. A sprayer according to claim 37, wherein said means on said output shaft is first cam means and said means on said outer end of said actuator means is second cam means.

39. A sprayer according to claim 38, wherein said first cam means includes a cam surface in a plane at an angle to said output shaft and said second cam means includes a cam surface in a plane at an angle to said pump axis.

40. A sprayer according to claim 39, wherein said first and second cam means interengage for axially displacing said end wall of said pump member toward said end wall of said cylinder, and spring means axially biasing said actuator means to bias said end wall of said pump member away from said end wall of said cylinder.

41. A sprayer according to claim 40, wherein said means providing an outlet for connecting said pump means with said discharge opening includes an outlet tube integral with said end wall of said cylinder and having an outer end spaced forwardly therefrom, nozzle means on said outer end having said discharge opening therethrough, means providing said end wall of said cylinder with an opening and a valve seat communicating said outlet tube with said cylinder, check valve means in said outlet tube having seated and unseated positions with respect to said valve seat, and spring means in said outlet tube for biasing said valve means toward said seated position thereof.

42. A sprayer according to claim 41, and a spinner member in said outlet tube having an end adjacent said nozzle means for imparting a swirling movement to fluid discharged through said discharge opening, said spring means being between said valve means and said spinner member for biasing said spinner member towards said nozzle means.

43. A sprayer according to claim 42, wherein said means providing an inlet for connecting said pump means with fluid in said supply container includes an inlet tube integral with said cylinder and providing an inlet opening thereinto transverse to said pump axis, and check valve means for closing said inlet opening to preclude the flow of fluid from said chamber through said inlet opening.

44. A sprayer according to claim 43, wherein said end of said pump member in said cylinder overlies said inlet opening to provide said check valve means.

* * * * *